United States Patent [19]

Anderie

[11] 4,234,208

[45] Nov. 18, 1980

[54] BINDING FOR SECURING A BOOT OR SHOE ON A TOURING OR CROSS-COUNTRY SKI

[75] Inventor: Wolf Anderié, Strasbourg, France

[73] Assignee: Adidas Fabrique de Chaussures de Sport, Strasbourg, France

[21] Appl. No.: 9,151

[22] Filed: Feb. 5, 1979

[30] Foreign Application Priority Data

Feb. 9, 1978 [FR] France ..... 78 03709

[51] Int. Cl.[3] ..... A63C 9/08

[52] U.S. Cl. ..... 280/614; 280/629

[58] Field of Search ..... 280/11.33, 614, 626, 280/628, 629, 615

[56] References Cited

U.S. PATENT DOCUMENTS 3,179,434 4/1965 Minisini ..... 280/628

3,272,523 9/1966 Marker ..... 280/629

3,403,921 10/1968 DeBeausacq ..... 280/628

*Primary Examiner*—John J. Love

*Assistant Examiner*—Norman L. Stack

*Attorney, Agent, or Firm*—Brisebois & Kruger

[57] ABSTRACT

A binding for the heel of a ski boot or shoe used with a cross-country or touring ski. The binding arrangment includes an axial rib on the ski which engages in a longitudinal groove in the bottom of the heel of the ski boot. The heel of the ski shoe has a transverse recess above the groove and a fastening element connected to the ski behind the region of the heel of the boot has a projection which can enter the transverse recess of the heel of the shoe to thus hold the heel against both vertical and transverse movement with respect to the ski. The front of the boot can be fastened to the ski in any desired manner and the shoe, when the heel binding is released, is then free to flex so that the skis can be used for "walking".

4 Claims, 5 Drawing Figures

BINDING FOR SECURING A BOOT OR SHOE ON A TOURING OR CROSS-COUNTRY SKI

BACKGROUND OF THE INVENTION

The present invention relates to a binding or device for fixing a boot or shoe on a touring or cross-country ski.

Fixing a boot to a cross-country ski is accomplished by binding the front of the boot to the ski. Thus the boot is held to the ski by its front or toe portion and the heel may be raised considerably off the ski as the skier moves. In practice it is thus often difficult to keep the axis of the skier's foot aligned with the axis of the ski.

In order to keep the boot from pivoting with respect to the ski when the skier rests his heel on the ski, particularly during descents, the assignee of applicant has already described in French Pat. application No. 7601536 a fixing device in which the heel of the boot has at least one slot, in the form of a groove extending along the axis of the ski, while the ski has at least one rib disposed along its axis, this rib engaging in the groove in the heel of the boot when the skier presses his heels on his skis.

SUMMARY OF THE INVENTION

The present invention proposes to provide a device for binding a boot on a touring or cross-country ski which also improves the retention of the boot on the ski particularly during descents, notably with the advantage of obtaining better control and conduct of the skis during turns and permitting the skier to place his skis in the so-called snow-plow position, in which the tips of the skis are brought together, the skis forming a V with its point facing to the front. The present invention has as its object, as a new industrial product, a binding or fixing device for fixing a shoe or boot on a touring or cross-country ski comprising means for fixing the front of the boot on the ski and a rib placed along the axis of the ski and designed to engage a longitudinal groove in the base of the heel of the boot when the skier rests his heel on the ski, characterized by the fact that it comprises a fixing device including a fixed lower portion, secured to the ski, and having the said rib, and an upper portion, connected to the lower portion and able to rotate with respect to it between a first position in which a projecting flange integral with the upper portion engages a transverse groove in the rear face of the heel of the boot above its longitudinal groove, when the rib on the lower portion of the fixing device is engaged in the longitudinal groove of the boot, and at least one second position in which the flange is disengaged from the transverse groove, return means being provided to pull the upper portion of the fixing device back against its lower portion in each of the positions.

In one preferred embodiment the heel binding of the device according to the invention includes an upper portion constituted of a hollow cap with a base which is essentially truncated in shape and ovoid in cross-section whose tapered portion is extended to constitute the projection to engage in the transverse groove in the heel of the boot, and an upper knob with flat transverse sides basically perpendicular to its base, and a lower portion comprising means for fixing on the ski, one front plate having the longitudinal rib on its upper face, and an enlarged rounded central zone in the shape of an upside down pot whose upper end wall has an opening traversed by a threaded bolt with its end screwed into a threaded bushing preferably truncated in section and fixed to the cap being preferably a force-fit in a central opening of the knob. A helical spring surrounds the bolt between its head and the upper end wall of the enlarged central zone.

In one particular form of the embodiment, the end wall of the enlarged central zone in the shape of an upside down pot is inclined at an angle with respect to the horizontal of, for example, about 15°, so that the bolt and therefore the upper knob of the cap are tilted at a corresponding angle with respect to the vertical, the base of the said cap thus equally being tilted at a corresponding angle with respect to the horizontal.

The head of the threaded bolt may advantageously be provided with a slot permitting the threaded shaft to be turned with respect to the corresponding screwed bushing, for example, with a screw-driver, thus adjusting the return force of the spring.

Of course, with the embodiment of the device according to the invention, when the projection, formed by the tapered portion of the base of the cap which constitues the upper portion of the fixing device, engages the transverse groove of the boot, the effect of the spring holds the boot vertically with respect to the ski, combined with a lateral hold due to the engagement of the longitudinal groove of the boot with the rib which is integral with the lower portion of the binding. When the user wishes to disengage the boot all he need do is turn the knob of the upper portion of the fixing device with respect to the lower portion around the axis of rotation consisting of the threaded bolt and which can turn in the opening in the end wall of the enlarged central zone in the shape of an upside down pot of the lower portion. It may, for example, rotate through an angle of 180°, so as to disengage the projection from the transverse groove of the boot, this projection being then in the disengaged position and turned, for example, toward the back of the ski and the skier can then freely lift his heel, the latter still engaging the longitudinal groove when the boot is rested on the ski.

The present invention also has as its object by way of a new industrial product, a touring or cross-country ski, characterized by the fact that it includes a binding as described above, this binding being mounted on the ski behind the area of support for the heel of the boot.

The present invention also has as its object by way of a new industrial product, a boot to be used in touring or cross-country skiing which on the one hand has in its front portion any conventional means for fixing the boot to a ski, and which on the other hand has in its heel a groove placed along the axis of the boot in the base of the heel and a transverse groove in the rear face of the heel above the longitudinal groove.

In order to make the invention more clearly understood, one embodiment will now be described by way of non-limiting example with reference to the attached drawings.

Figure 1:
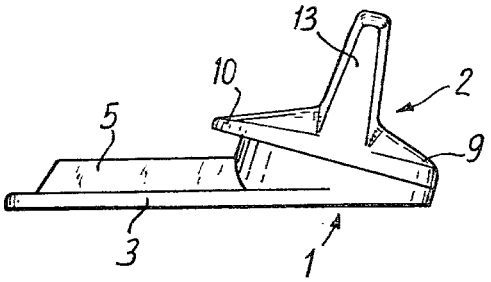
FIG. 1 is a side view in elevation of a binding of the device according to the invention.
Figure 2:
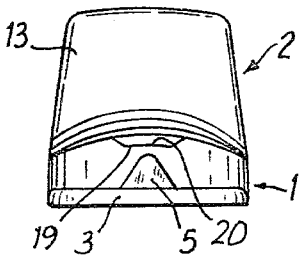
FIG. 2 is a front view in elevation of the binding of FIG. 1.

Referring to the drawing, it will be seen that the fixing device or binding according to the present invention includes a lower portion designated as a whole by 1 and an upper portion in the form of a hollow cap or knob 2. The lower portion 1 has a front plate 3 provided with means for fixing the plate to the upper face of the ski, for example, in the form of holes 4 (FIG. 3) for the passage of screws or similar fastening means.

This front plate 3 has a rib 5, which can have a triangular section with a peak angle of about 60°, this rib 5 being disposed axially in plate 3 so as to extend along the axis of the ski when the binding is fastened on the ski.

The lower portion 1 also has a rounded central boss 6 in the shape of an inverted pot whose upper end wall 7 has a central opening 8.

Figure 4:
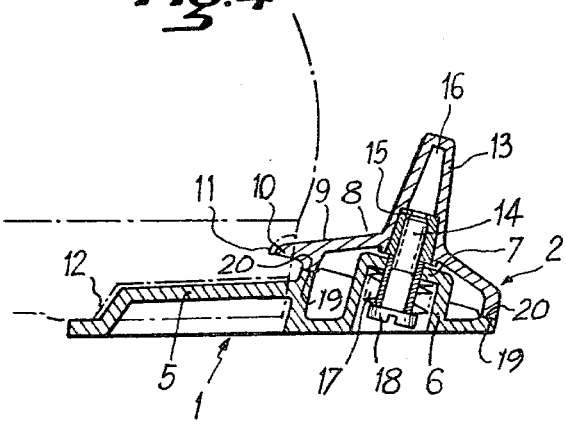
FIG. 4 is a view in longitudinal section of the binding with its flange in a position to immobilize the back of a boot.
Figure 5:
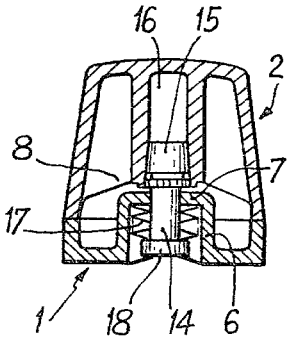
FIG. 5 is a transverse vertical section of the binding.

As FIG. 4 shows more clearly, the end wall 7 of the boss 6 is tilted with respect to the horizontal by, for example, an angle of 15°, and its sidewall is tilted with respect to vertical by the same angle.

Figure 3:
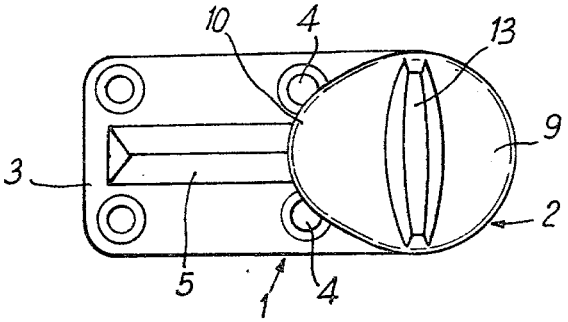
FIG. 3 is a top plan view of the binding.

The upper portion 2 of the fastening device or binding has a base 9 which is basically tapered and has an ovoid cross-section as FIG. 3 shows most clearly. The curved beveled flange portion 10 of base 9 engages, as FIG. 4 shows, a transverse groove 11 in the upper portion of the rear face of the heel of the boot, the boot also having at the base of the heel a longitudinal groove 12 by which it can engage the axial rib 5 of the lower portion 1 of the fastening device.

The upper portion 2 has an integral transversely elongated knob 13 basically perpendicular to base 9 and constituting the gripping element by which the skier may grasp the upper portion of the fastening device to pivot it with respect to the lower portion 1.

This pivoting is accomplished by means of a bolt 14 engaged in the orifice 8 of the bottom wall 7 of the rounded central boss 6 of lower portion 1, the threaded end of bolt 14 being screwed into a truncated nut 15 secured to upper portion 2 and being a force-fit in a central well or opening 16 of knob 13 of upper portion 2.

A helical hold-down spring 17 is also interposed between the head 15 of the bolt 14 and the bottom wall 7.

Surrounding the boss 6 of lower part 1 is a circular wall the top surface of which is engaged by the annular bottom surface of the upper part 2. Upper part 2 has a pair of diametrically opposed tongues 19 at its bottom edge which seat in recesses 20 of the circular wall of lower part 1 to prevent accidental rotation of upper part 2, and to hold the part 2 in the boot engaging as well as the boot released position. The sides of the tongues 19 and recesses 20 are beveled so that turning knob 13 lifts the upper portion against the force of spring 17, the spring pulling the upper part down when the tongues are aligned with the recesses.

In the position shown in FIG. 4 which corresponds, for example, to a descent position of the skier, the boot is immobilized by its heel with respect to the ski both vertically, because of the engagement of projection 10 in groove 11 of the heel, and horizontally, because of the engagement of rib 5 in longitudinal groove 12 of the heel.

When the skier wants to resume a normal advance, by walking the skis, after a descent, all he need do is turn knob 13 to disengage projection 10 from groove 11 of the heel of the boot by rotating the upper portion 2 of the fastening device with respect to the lower portion 1. The skier can thus, by a 180° rotation, bring projection 10 to point toward the back in an opposite position from that shown in the drawing in FIGS. 1, 3 and 4. Of course, the hold-down spring 17 causes the upper portion 2 to be pulled against lower portion 1 in this position as well as in the position shown in FIG. 4 where the projection 10 is engaged in groove 11 of the heel of the boot, as in any other rotational position where projection 10 is either engaged or disengaged from groove 11 of the heel. The force of the hold-down spring 17 may be modified by screwing or unscrewing the threaded bolt 14 with respect to the bushing 15 by means of a screw-driver placed in a slot in the head 18 of the threaded bolt 14. The respective threads of the bolt and bushing are preferably self-locking to prevent accidental unthreading.

As may be seen from the drawing, since the bottom wall 7 of the rounded central boss 6 of lower portion 2 is tilted with respect to the horizontal, bolt 14 constituting the pivoting axis is also tilted at a corresponding angle with respect to the vertical so that base 9 of upper portion 2 is tilted at a corresponding angle with respect to the horizontal, as knob 13 is with respect to the vertical.

Although the invention has been described in connection with one preferred embodiment, it will be clear that it is in no way limited to this and that any desirable modifications may be made without departing in any way from the scope or the principles of the invention.

What is claimed is:

1. A device for fastening a boot on a touring or cross country ski comprising an articulated means for fixing the front of the boot on the ski and a rib disposed along the axis of the ski to engage a longitudinal groove in the bottom of the heel of the boot when the skier rests his heel on the ski, said fastening device including a stationary lower portion fixed to the ski and presenting said rib, and an upper portion comprising, an integral projecting curved flange, inclined at an angle with respect to the horizontal, means connecting the upper portion to the lower portion for rotation with respect to the lower portion between a first position in which said projecting flange engages a transverse groove in the rear face of the heel of the boot above its longitudinal groove, when the rib on the lower portion of the fastening device is engaged in said longitudinal groove of the boot, and at least one second position in which said projecting flange is disengaged from said transverse groove, and return means for pulling said upper portion of the fastening device against its lower portion in each of the said positions, and grippable means on said upper portion for rotating said upper portion to said first and second positions.

2. A device according to claim 1, wherein said upper portion comprises a hollow cap having a base in the shape of an essentially truncated cone and ovoid in cross-section and whose extending portion comprises said projection to engage the transverse groove in the heel of the boot, and an upper transverse knob basically perpendicular to the said base, and said lower portion comprises means for fixing the lower portion on a ski, a front plate having on its upper face said longitudinal rib to engage said longitudinal groove in the heel of the boot, and a rounded central boss in the shape of an inverted pot whose upper end wall has an opening traversed by a bolt threaded into a bushing rigid with the cap and in a central well of the knob and said return means comprises a helical spring surrounding said bolt between its head and the upper end wall of said rounded central boss.

3. A fastening device according to claim 1, wherein said angle of inclination is approximately 15°.

4. A touring or cross-country ski characterized by the fact that it has mounted thereon behind the heel support region of the ski a fastening device according to any one of claims 2, 3 or 1.

* * * * *